US006542064B2

(12) United States Patent
Endo et al.

(10) Patent No.: US 6,542,064 B2
(45) Date of Patent: Apr. 1, 2003

(54) FUSE

(75) Inventors: Takayoshi Endo, Shizuoka (JP); Takahiro Sato, Shizuoka (JP); Hiroki Kondo, Shizuoka (JP); Norihiro Ohashi, Shizuoka (JP); Goro Nakamura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/811,575

(22) Filed: Mar. 20, 2001

(65) Prior Publication Data

US 2001/0028294 A1 Oct. 11, 2001

(30) Foreign Application Priority Data

Mar. 22, 2000 (JP) ..... 2000-079227

(51) Int. Cl.[7] ..... H01H 85/38; H01H 85/175; H01H 85/08

(52) U.S. Cl. ..... 337/278; 337/282; 337/234; 337/252; 337/295

(58) Field of Search ..... 337/186, 187, 337/228, 231, 234, 251, 252, 262, 260, 278, 282, 290, 295; 29/623; 439/621, 622, 830, 890, 893

(56) References Cited

U.S. PATENT DOCUMENTS 441,933 A * 12/1890 Cartwright ..... 337/278
480,802 A * 8/1892 Blathy ..... 337/278
4,544,907 A * 10/1985 Takano ..... 337/262
4,604,602 A 8/1986 Borzoni
4,670,729 A * 6/1987 Oh ..... 337/255
4,827,238 A * 5/1989 Kozel ..... 337/255
4,894,633 A * 1/1990 Holtfreter ..... 337/201
4,986,767 A * 1/1991 Kozel ..... 337/255
5,101,187 A * 3/1992 Yuza ..... 337/255
5,113,169 A * 5/1992 Ruehl et al. ..... 337/265
5,929,740 A * 7/1999 Oh et al. ..... 337/180
5,977,859 A * 11/1999 Kawamura et al. ..... 29/623
6,407,657 B1 * 6/2002 Oh ..... 337/181

FOREIGN PATENT DOCUMENTS

GB 2090081 A * 6/1982 ..... H01H/85/54
JP 7-20828 5/1995

* cited by examiner

*Primary Examiner*—Anatoly Vortman
(74) *Attorney, Agent, or Firm*—Armstrong, Westerman & Hattori, LLP

(57) ABSTRACT

A fuse 1 includes a pair of terminals 2, a housing 4 and a fusible body 5. The one ends 3*a* of the terminals 2 are housed within the housing 4. The housing 4 includes a pair of end walls 12*a*, 12*b*, a pair of side walls 13*a*, 13*b*, a first partition wall 21 and a pair of second partition walls 22. The inner faces 15*a*, 15*b* of the pair of end walls 12*a*, 12*b* are opposite to each other in a direction orthogonal to the direction of arranging the terminals in parallel and extend along the end faces of the terminals. The inner faces 16*a*, 16*b* of the side walls 13*a*, 13*b* are opposite to each other in a direction of arranging the terminals in parallel. The first partition wall 21 is located between the pair of terminals 2. The pair of second partition walls 22 are located between the first partition wall and the inner faces 16*a*, 16*b*, respectively.

3 Claims, 4 Drawing Sheets

FUSE

BACKGROUND OF THE INVENTION

1. Field of the Invention

This invention relates to fuse.

2. Description of the Related Art

A motor vehicle which is a moving body includes a large number of power transmission lines for transmitting power itself and various signals, such as bas bars in electric connection boxes (junction block, relay box, fuse block, etc.), terminals for connectors for electric connection.

The main tendency of the voltage of the power transmitted along the power transmission line is 14 V for a general passenger car, and 28 V (14×2) for a large scale vehicle such as a bus or truck (both in terms of an effective voltage). However, particularly for the passenger car, it has been proposed to adopt a power system for supplying an electric power with a higher voltage value than before in view of demands of improvement in driving efficiency of loads and driving with at an optimum efficiency for each load.

The above power transmission line includes fuse blocks from which a large number of fuses can be removed in order to protect electric circuits for various electric appliances (since the fuse block may have a relay or bus bar, it is referred to as a relay box or junction block, or generally referred to as "electric connection box". In this specification, the above fuse block, relay box, junction block are generally referred to as "electric connection block.

The fuse which has been conventionally used for the electric connection block is such a fuse 51 as shown in FIG. 7. The fuse 51 includes a pair of terminals 52 arranged in parallel, a housing 54 which houses one ends 53 of these terminals 52 and a fusible body 55 which is formed integrally to the pair of terminals 52 and connect them to each other.

When the fuse 51 is mounted in the electric connection box, the terminals 52 are electrically connected to receiving terminals of the box, respectively. One of the receiving terminals is supplied with an electric power whereas the other thereof is electrically connected to various loads. Thus, the one of the terminal 52 is supplied with the electric power through the receiving terminal whereas the other thereof is connected to the loads. The terminals 52 are housed within the housing 54 in a state where their inner faces 61 are opposite to each other.

The housing 54 is made of insulating synthetic resin. The housing 54 is formed in a box shape. The interior of the housing 54 constitutes a housing chamber within which the one ends of the above pair of terminals 52 are housed.

The fusible body 55 connects the one ends 53 of the terminals 52 to each other. The fusible body 55 is coupled at its both ends with the inner faces 61 which are located at the one ends 53 of the terminals 52. The fusible body 55 includes a fusing portion 62 which fuses when the current value of the electric power supplied from the one of the terminals 52 exceeds a prescribed current value. The fusible portion 62 is formed to have a small sectional area of the fusible body 55.

Where the fuse 51 thus configured is mounted on the electric connecting box, when the current value of the electric power supplied from the one of the terminals 52 through the one receiving terminal exceeds the prescribed current value, the fusing portion 62 of the fusible portion 55 fuses to stop supply of the electric power to the load.

In the fuse 51 shown in FIG. 7, since the fusible 55 is coupled with the opposite inner faces of the terminals 52, there is a relatively small space 60 (FIG. 7) in which the fused potion 62 of the fusible body 55 formed between the inner faces 61 within the housing chamber can scatter. Further, it is generally known that the fusing portion 62 of the fusible body 55 scatters higher momentum as the current value in fusing increases.

In the above conventional fuse 51, when the fusing potion 62 of the fusible body 55 fuses with a higher current value than before, it scatters with higher momentum. The fused fusible body 55 might short-circuits the terminals to each other within the space 60.

This means difficulty of assuring the insulation between the terminals 52. In this case, supply of the electric power to the load which should be stopped may continue, and therefore the electric power with an excessive current value may be supplied to the load.

An object of this invention is to provide a fuse which can surely stop supply of an electric power to a load when the electric power with the current which exceeds a current value of fusing a fusible body is supplied.

In accordance with this invention, there is provided a fuse including a pair of terminals arranged in parallel, a housing having a housing chamber for housing respective one ends thereof and a fusible body for coupling said pair of terminals with each other, wherein said housing comprises:

a pair of first inner walls which constitute said housing chamber and are opposite to each other in a direction orthogonal to the direction of arranging said pair of terminals in parallel; and a first partition wall which is located between said pair of terminals in the direction of arranging the terminals in parallel and extends from the one of said first inner walls toward the other thereof.

In this configuration, since the pair of first inner walls are opposite to each other in a direction orthogonal to the direction of arranging said pair of terminals in parallel, the first partition wall which extends from the one of said first inner walls toward the other thereof extends along the terminals. In addition, the first partition wall is located between the pair of terminals. In short, the first partition wall extends along the terminals between them. Because of such a configuration, when the fusible body is fused and deposited on the surfaces of the terminals, the first partition wall prevents the fusible body thus deposited from being connected mechanically and electrically.

In the fuse described above, the housing preferably a pair of second partition walls which extend from said other of said first inner walls toward said one thereof and located between said first partition wall and said pair of second inner walls, respectively, in a direction of arranging the terminals in parallel.

In this configuration, the pair of second partition walls which extend from said other of said first inner walls toward said one thereof and located between said first partition wall and said pair of second inner walls, respectively. Because of this configuration, when the fusible body 5 is fused and deposited on the surfaces of the terminals 2, these first and second partition walls prevent the fusible body thus deposited from being connected mechanically and electrically.

In the fuse described above, said first partition wall and said pair of second partition walls extend to a center position between said pair of first inner walls. Because of this configuration, when the fusible body 5 is fused and deposited on the surfaces of the terminals 2, the partition walls more surely prevent the fusible body thus deposited from being connected mechanically and electrically.

Further, in the fuse described above, between a coupling position with the one of said pair of terminals and another coupling position with the other thereof, said fusible body is formed to bend along the one of the second partition walls, the first inner walls, first partition wall and the other of said second partition walls. This configuration makes it difficult for the fused fusible body 5 to be deposited on the surfaces of the terminals 2. Therefore, after the fusible body 4 has fused, the fuse 1 surely prevents the pair of the terminals 2 from being communicated with each other. Thus, when the power with a current value which exceeds the fusing current value of the fusible body is supplied, supply of the power to the load can be surely stopped.

The above and other objects and features of the invention will be more apparent from the following description taken in conjunction with the accompanying drawings.

DESCRIPTION OF THE PREFERRED EMBODIMENTS

Embodiment 1

Figure 1:
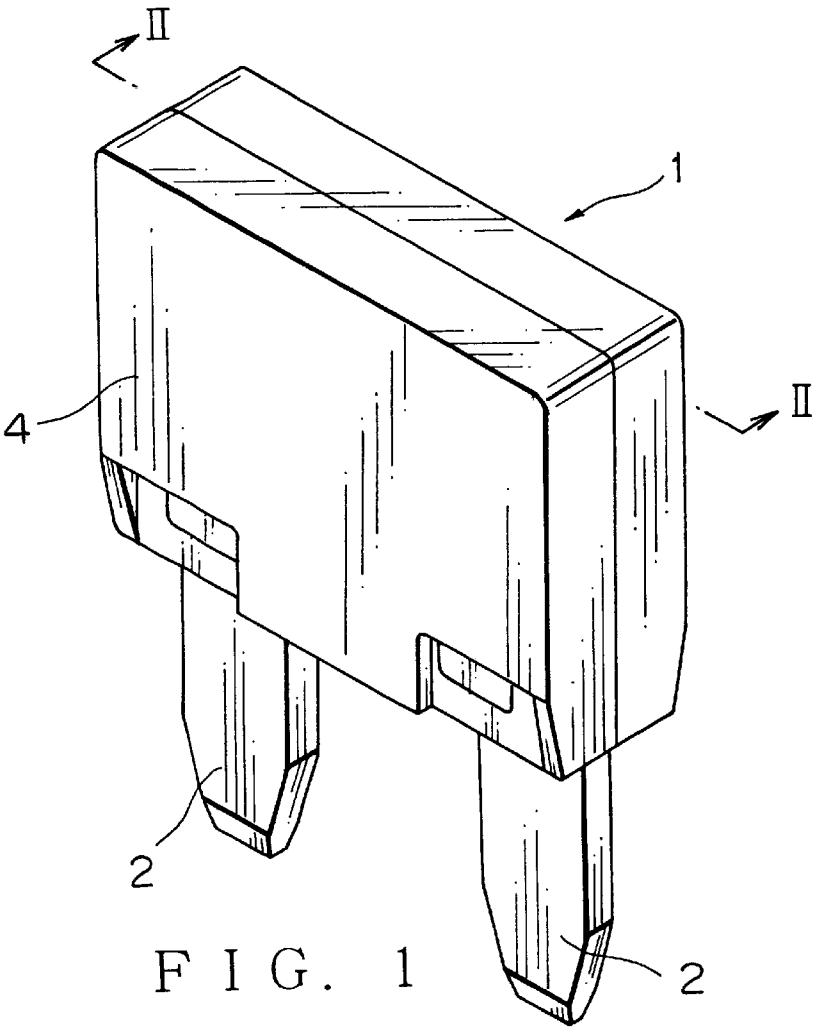
FIG. 1 is a perspective view of a fuse according to a first embodiment of this invention.

Now referring to FIGS. 1 to 3, an explanation will be given of the fuse according to the first embodiment of this invention. As seen from FIGS. 1 and 2, fuse 1 includes a pair of terminals 2 arranged in parallel to each other, a housing 4 which houses the one ends 3*a* of these terminals and a fusible body 5 which connects the terminals 2 to each other.

The terminal 2 is made of a conductive material, respectively. The terminal 2 is formed in a plate shape. The terminal 2 has a recess 6 and an attaching hole 7. The terminal 2 is provided so that its one end 3*a* is housed within the housing 4 and its other end 3*b* is exposed outside the housing 4.

Figure 2:
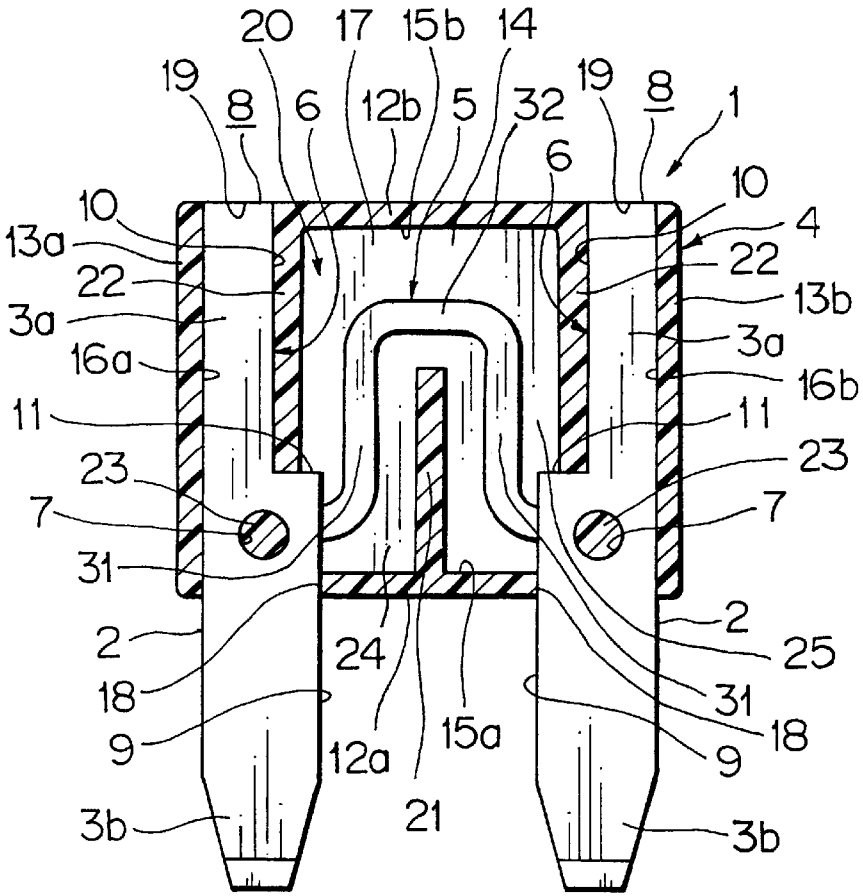
FIG. 2 is a sectional view taken in line II—II in FIG. 1.
Figure 3:
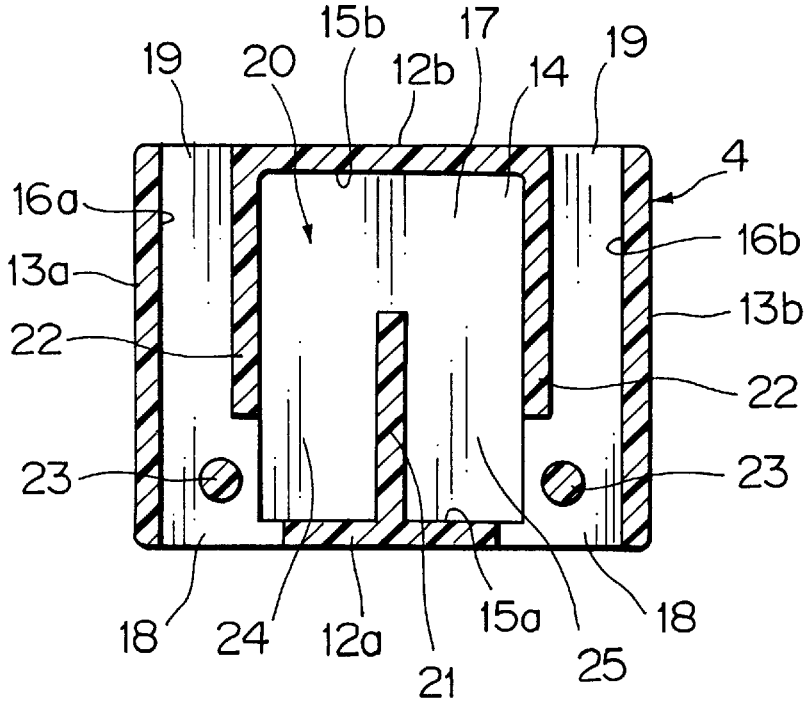
FIG. 3 is a sectional view of a housing for a fuse shown in FIG. 1.

As seen from FIG. 2, the recess 6 is formed at the one end 3*a* of the terminal 2. The recess 6 is formed in concavity from the inner face 9 located at the other end 3*b*. The inner faces 9 of the terminals 2 are opposite to each other when the terminals are arranged in parallel. The recesses 6 are formed so that the interval between the terminals 2 extend stepwise from the interval between the inner faces 9. The recess 6 includes a flat face 10 and a step face 11. The flat face 10 extends from the end face 8 located at the one end 3*a* of the terminal 2 to the central portion of the terminal 2 in its longitudinal direction. The step face 11 couples the flat face 10 and the inner face 9 with each other.

The flat faces 10 are formed so that the interval therebetween is wider than that between the inner faces 9.

The flat faces 10 constitute an inner face in this specification. The step faces 11 are formed in a direction of arranging the pair of terminals 2 in parallel. The recesses 6 are located within the housing 4 in a state where the terminals 2 have been attached to the housing 4.

The attaching holes 7 are formed so that they penetrate through the terminals 2. The attaching hole 7 is provided at the central potion of the terminal 2 in the longitudinal direction. The attaching hole 7 is circular in section.

When the fuse 1 is mounted in the electric connection box, the terminals 2 are electrically connected to receiving terminals of the box, respectively. One of the receiving terminals 2 is supplied with an electric power whereas the other thereof is electrically connected to various loads. Thus, the one of the terminal 2 is supplied with the electric power through the receiving terminal whereas the other thereof is connected to the loads.

The housing 4 is made of insulating synthetic resin. The housing 4 is formed in a box shape. The interior of the housing 54 constitutes a housing chamber within which the one ends of the above pair of terminals 52 are housed. As seen from FIGS. 2 and 3, the housing 4 includes a pair of end walls 12*a*, 12*b*, a pair of side walls 13*a*, 13*b* and a pair of frame walls 14.

The pair of end walls 12*a*, 12*b* are opposite to each other in a direction crossing the direction of arranging the pair of terminals in parallel. When the terminals 2 are housed in the housing 4, the end wall 12*b* is flush with the end face 8. The pair of end walls 12*a*, 12*b* are also opposite to each other in a direction perpendicular to the direction of arranging the pair of terminals in parallel. The pair of side walls 13*a*, 13*b* are opposite to each other in the direction of arranging the pair of terminals in parallel. The pair of side walls 13*a*, 13*b* are also formed in the longitudinal direction of the terminals 2.

The pair of frame walls 14 are opposite to each other in a direction crossing the direction of arranging the pair of terminals 2 to each other. The pair of frame walls 14 are communicated with both of the end walls 12*a*, 12*b* and side walls 13*a*, 13*b*, respectively. Incidentally, in FIGS. 2 and 3, only the frame wall 14 in the inside is shown.

A space 20, which is surrounded by the respective inner faces 15*a*, 15*b* of the end walls 12*a*, 12*b*, respective inner faces 16*a*, 16*b* of the side walls 13*a*, 13*b* and respective inner faces 17 of the frame walls 14, constitutes a housing chamber for housing the one ends 3*a* of the terminals 2. Incidentally, the respective inner faces 15*a*, 15*b* of the pair of end walls 12*a*, 12*b* constitute first inner walls in this specification, and the respective inner faces 16*a*, 16*b* of the pair of side walls 13*a*, 13*b* constitute second inner walls in this specification.

The end wall 12*a* which is located at the central portions of the terminals 2 includes a pair of through-holes 18 through which the terminals 2 are passed, respectively. On the other hand, the end wall 12*b* which is located at the end faces of the terminals 2 includes a pair of exposing holes 19 to which the respective end faces of the terminals 2 are exposed, respectively.

The housing 4 includes terminal position pins 23, a first partition 21 and a pair of second partition walls 22. The terminal positioning pins 23 are provided at a position in the vicinity of the side wall 13*a* and close to the end wall 12*a* and and another position in the vicinity of the side wall 13*b* and close to the end wall 12*a*.

The terminal positioning pins 23 are provided to protrude from the inner face 17 of at least one of the frame walls 14 in a direction the pair of frame walls 14 approach each other. The terminal positioning pin 23 is adapted to invade the attaching hole 7 of the terminal 2.

In the configuration described above, the one ends 3*a* of the terminals 2 are housed in the housing chamber 20 in a state where the terminal positioning pins 23 of the housing 4 are passed through the attaching holes and located inside the side wall 13*a*, 13*b*. In this case, the terminals 2 are passed through the through-holes 18 of the end wall 12*a* and their end faces 8 are exposed outside from the exposing holes 19, respectively.

The partition wall 21 extends from the inner face 15*a* of the one end wall 12*a* to the inner face 15*b* of the other end wall 12*b*. The partition wall 21 extends in the longitudinal direction of the side walls 13*a*, 13*b* and terminals 2.

The partition wall 21 is formed at a central position between the terminals arranged in parallel. The partition wall 21 extends to a central position between the pair of end walls 12*a*, 12*b*. In this way, the partition wall 21 extends from one of the inner faces 15*a*, 15*b* from the other thereof.

The partition wall 21 partitions the housing chamber 20 formed in the housing 4 into a first chamber 24 which houses the end 3*a* of one of the terminals 2 and a second chamber 25 which houses the end 3*a* of the other of the terminals 2. FIG. 2 shows the first chamber 24 located at the left side and the second chamber 25 located at the right side.

The second partition walls 22 extends from the inner face 15*b* of the end wall 12*b* toward the inner face 15*a* of the end wall 12*a*.

The second partition walls 22 are formed at the edges of the exposing holes 19, respectively. The second partition walls 22 extend in the longitudinal direction of the side walls 13*a*, 13*b* and terminals 2, respectively. The second partitions 22 each is located between the inner face 16*a*, 16*b* of the side wall 13*a*, 13*b* and the partition wall 21. The second partitions 22 extend to the central position of the pair of end walls 12*a* and 12*b*, and hence between the inner faces 15*a* and 15*b*.

The second partition walls 22 face the flat faces 10 of the terminals 2 in the state where the terminal positioning pins are fit in the attaching holes, and covers these flat faces 10. In this way, the partition walls 22 extend from the inner face 15*b* to the inner face 15*a*.

The fusible body 5 connects the terminals to each other. The fusible body 5 is formed a liner shape which is square in section. The fusible body 5 has a width, thickness and length enough to fuse when the supplied power exceeds a prescribed current value. In this embodiment, the fusible body 5 and the pair of terminals can prepared using a certain material subjected to rolling, cutting and stamping. In other words, the fusible body 5 and the pair of terminals are formed integrally.

Both ends of the fusible body 5 are coupled with the inner faces 9 of the terminals 2, respectively. The fusible body 5 consists of a pair of extending portions 31 and a coupling portion 32. The extending portions 31 extend from their coupled position with the inner faces 9 of the corresponding terminals 2 toward the end wall 12*b* to leave the terminals 2.

The extending portions 31 are provided at the centers between the partition wall 21 and the corresponding second partition walls 22 in the direction of arranging the terminals 2. The extending portions 31 also extend along the side walls 13*a*, 13*b* and partition walls 21, 22.

The coupling portion 32 couples the ends of the extending portions with each other. The coupling portion 32 is provided between the end walls 12*a* and 12*b* and between their inner faces 15*a* and 15*b*. The coupling portion 32 extends along the inner faces 15*a*, 15*b* of the end walls 12*a*, 12*b*.

Between the coupling position with the one terminal 2 and the coupling position with the other terminal 2, the fusible 5 is formed to bend along the one of the second partition walls 22, inner faces of the end walls 12, 12*b*, partition wall 21 and the other of the second partition walls 22.

In operation, where the fuse 1 having the above configuration is mounted in the electric connecting box, if the current value of the power supplied to one of the terminals 2 through the one receiving terminal exceeds the prescribed current value, the fusible body 5 fuses to stop the supply of the power to the load.

In the fuse 1 according to this embodiment, the partition wall 21 of the housing 4 is located between the terminals 2 and also extends along the terminals. In addition, the partition wall 21 partitions the housing chamber 20 of the housing 4 into the first chamber 24 and the second chamber 25. For this reason, when the fusible body 5 is fused and deposited on the surfaces of the terminals 2, the partition wall 21 prevents the fusible body thus deposited from being connected mechanically and electrically.

Therefore, after the fusible body 4 has fused, the fuse 1 can prevent the pair of the terminals 2 from being communicated with each other. Thus, when the power with a current value which exceeds the fusing current value of the fusible body is supplied, supply of the power to the load can be surely stopped.

Further, in the fuse according to this invention, the second partition walls 22 of the housing 4 extend from the end wall 12*b* to which the partition wall 21 is not attached toward the end wall 12*a* to which the partition wall 21 is attached. In addition, the second partition walls 22 are provided between the side walls 13*a*, 13*b* and the partition wall 21, respectively.

For this reason, when the fusible body 5 is fused and deposited on the surfaces of the terminals 2, the partition wall 21 prevents the fusible body thus deposited from being connected mechanically and electrically. In addition, the second partition walls 22, which cover the opposite flat faces 10 of the terminals 2, suppress the deposition of the fused fusible body 1 on the surfaces of the terminals 2.

Therefore, after the fusible body 4 has fused, the fuse 1 can prevent the pair of the terminals 2 from being communicated with each other. Thus, when the power with a current value which exceeds the fusing current value of the fusible body is supplied, supply of the power to the load can be surely stopped.

Further, the partition wall 21 and the second partition walls 22 extend to the central position between the inner faces 15*a* and 15*b* of the end wall 12*a* and 12*b*. For this reason, when the fusible body 5 is fused and deposited on the surfaces of the terminals 2, the partition walls prevent the fusible body thus deposited from being connected mechanically and electrically.

Between the coupling position with the one terminal 2 and the coupling position with the other terminal 2, the fusible 5 is formed to bend along the one of the second partition walls 22, inner faces of the end walls 12, 12*b*, partition wall 21 and the other of the second partition walls 22. This makes it difficult for the fused fusible body 5 to be deposited on the surfaces of the terminals 2. Therefore, after the fusible body 4 has fused, the fuse 1 surely prevents the pair of the terminals 2 from being communicated with each other. Thus,when the power with a current value which exceeds the fusing current value of the fusible body is supplied, supply of the power to the load can be surely stopped.

In this embodiment, the partition wall 21 is formed to extend from the inner face 15*a* of the end wall 12*a* whereas the second partition walls 22 are formed to extend from the inner face 15*b* of the end wall 12*b*. However, inversely, the partition wall 21 may be formed to extend from the inner face 15*b* of the end wall 12*b* whereas the second partition walls 22 may be formed to extend from the inner face 15*a* of the end wall 12*a*.

Embodiment 2

Figure 5:
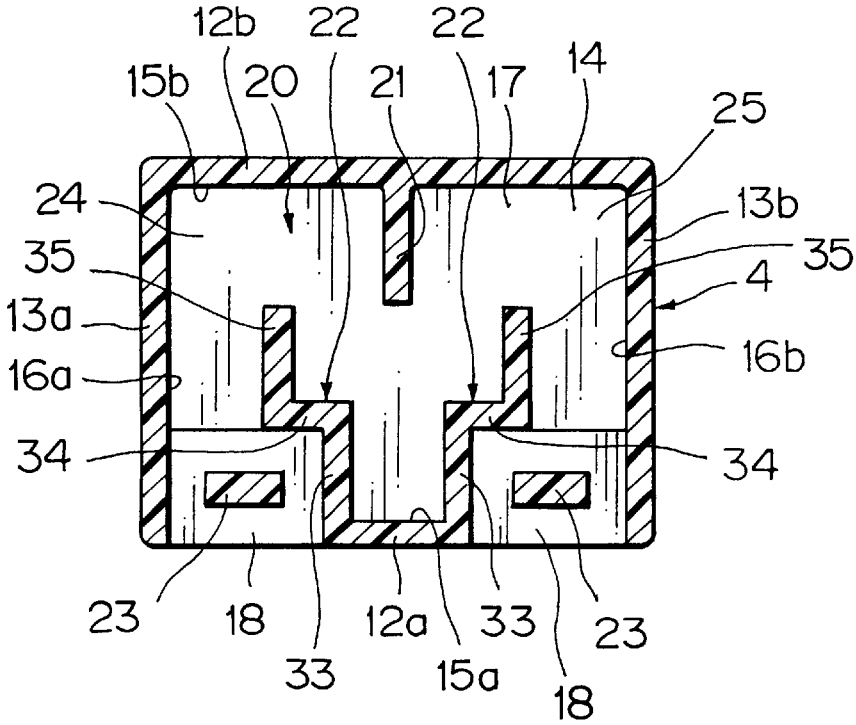
FIG. 5 is a sectional view of a housing for a fuse shown in FIG. 4.

Now referring to FIGS. 4 and 5, an explanation will be given of the fuse according to the second embodiment of this invention. In this embodiment, like reference numerals refer to like elements in the first embodiment.

Figure 4:
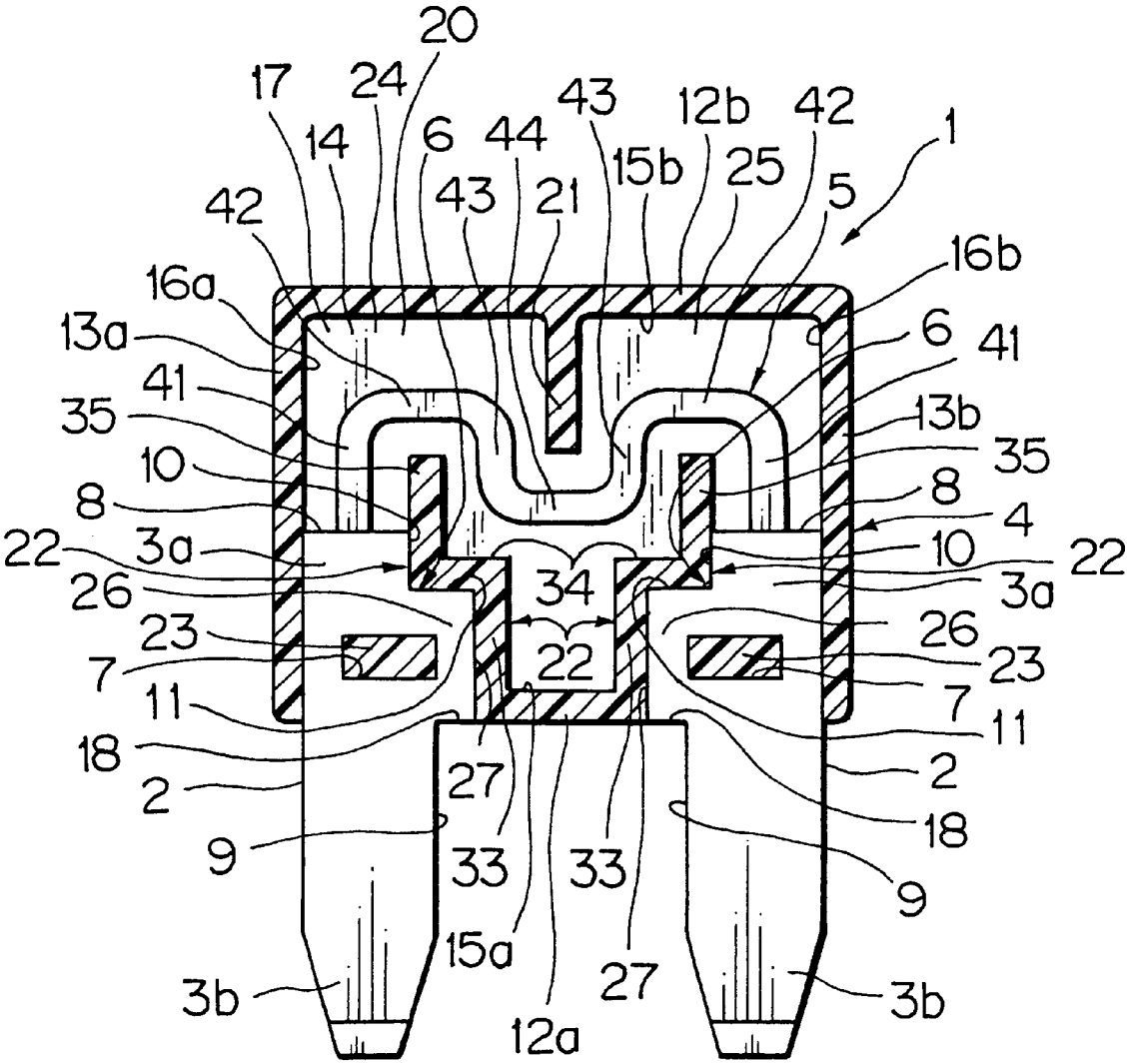
FIG. 4 is a perspective view of a fuse according to a second embodiment of this invention.
Figure 7:
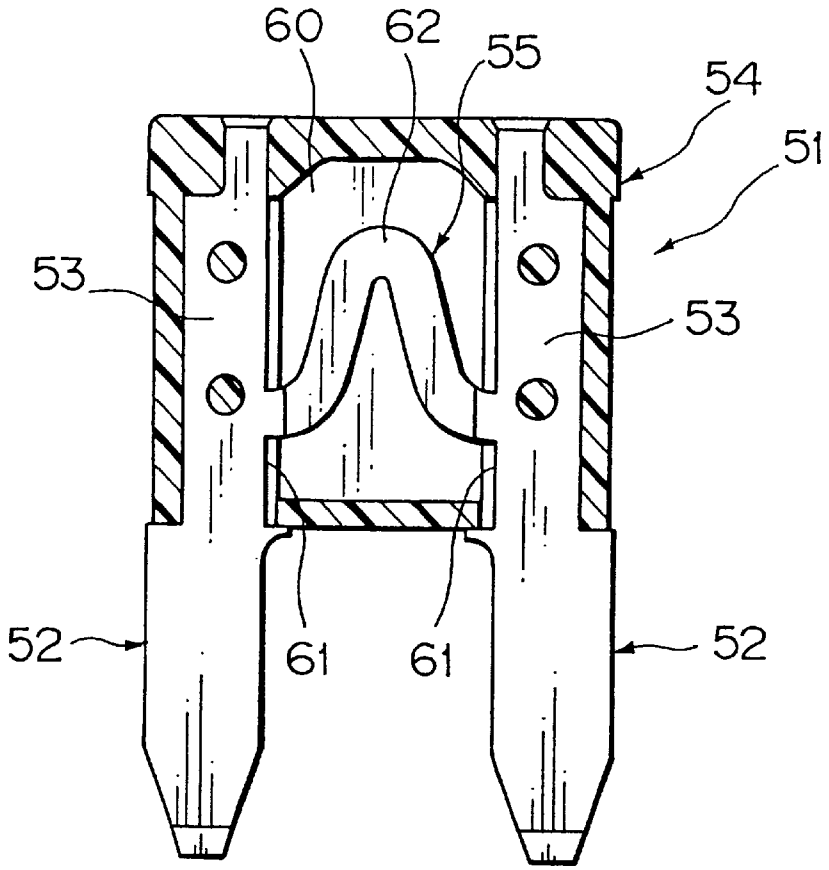
FIG. 7 PRIOR ART
FIG. 7 is a sectional view of the structure of a conventional fuse.

As seen from FIG. 4, in the fuse 1 according to this embodiment, the one ends 3*a* of the terminals 2 are housed within the housing chamber 20 so that the end faces 8 of the terminals are spaced apart from the end wall 12*b* of the housing 4. The terminals 2 includes attaching holes 7 at their one ends 3*a*, respectively. The terminals 2 have include inner protruding portions 26 at their one ends 3*a*, respectively.

The inner protruding portions 26 are formed to protrude in a direction the pair of terminals approach each other. The inner protruding portions 26 have opposite end faces 27. These end faces 27 are formed flatly along the longitudinal direction of the terminals 2. When the one ends 3*a* of the terminals 2 are housed in the housing chamber 20, these inner protruding portions 26 are also housed within the housing chamber 20. In this embodiment, the end face 27, step face 10 and flat face 10 constitute the inner face of the terminal 2 referred to in this specification.

In this embodiment, the attaching hole 7 of the terminal 2 and the terminal positioning pin 23 of the housing 4 have a square shape in section, respectively. However, they may be formed in a circular shape.

In this embodiment, the end wall 12*b* of the housing 4 of the fuse 1 does not include the exposing hole unlike the first embodiment. The partition wall 21 of the housing 4 extends from the inner face 15*b* of the end wall 12*b* toward the inner face 15*a* of the end wall 12*a*. The partition wall 21 is located at the center position between the terminals 2 in the direction of arranging them in parallel. The partition wall 21 extends in the longitudinal direction of the terminals 2.

The second partition walls 22 extend from the inner face 15*a* of the end wall 12*a* toward the inner face 15*b* of the end wall 12*b*. The second partition walls 22 are arranged in parallel in the direction of arranging the terminals in parallel. The second partition walls 22 are bent so that the interval therebetween increases stepwise from the inner face 15*a* of the end face 12*a* to the inner face 15*b* of the end wall 12*b*.

The second partition wall 22 consists of a first wall segment 33, a second wall segment 34 and third wall segment 35. The first wall segment 33 extends from the edge of the through-hole 18 of the end wall 12*a* toward the inner face 15*b* of the end wall 12*b* in the longitudinal direction of the terminal 2. The first wall segment 33 extends along the end face 27 of the inner protruding portion 26 of the terminal 2 and inner face 16*a*, 16*b*. The first wall segment 33 covers the end face 27 of the terminal 2 in the state where the one end 3*a* thereof is housed within the housing chamber 20.

The second wall segment 34 extends from the end of the first wall segment 33 located apart from the inner face 15*a* in a direction the terminals 2 leave each other. The second wall segment 34 extends along the step face 11 and the inner face 15*a*, 15*b*. The second wall segment 34 covers the step face 11 of the terminal 2 in the state where the one end 3*a* thereof is housed within the housing chamber 20.

The third wall segments 35 each extends from one of the ends of the second segment wall which is located more apart from each other toward the inner face 15*b* of the end wall 12*b* in the longitudinal direction of the terminal 2. The third wall segments 35 each extends along the flat face 10 of the recess 6 of the terminal 2 and inner face 16*a*, 16*b*. The third wall segments 35 each covers the flat face 10 of the terminal 2 in the state where the one end 3*a* thereof is housed within the housing chamber.

The third wall segment 35 is located at the center position between the inner face 16*a*, 16*b* of the side wall 13*a*, 13*b* and the partition wall 21 in the direction of arranging the pair of terminals 2.

A fusible body 5 according to this embodiment couples the respective end faces of the terminals 2 with each other. The fusible body 5 consists of a pair of first extending segments 41, a pair of second extending segments 42, a pair of third extending segments 43 and a coupling segment 44.

The first extending segments 41 each extends from the corresponding end face 8 toward the inner face 15*b* of the end wall 12*b* in a direction leaving the pair of terminals 2. The first extending segments 41 each is provided at the center position between the inner face 16*a*, 16*b* of the side wall 13*a*, 13*b* and the third wall segment 35. The first extending segments 41 each extends along the side wall 13*a*, 13*b*, first and third wall segment 33, 35 and partition wall 21.

The second extending segments 42 each extends from the end of the first extending segment 41 apart from the end face 8 in a direction they approach each other. The second extending segments 42 each is provided between the end of the third wall segment 35 and the inner face 15*b* of the end wall 12*b*. The second extending segments 42 each extends along the inner face 15*b* of the end wall 12*b* and the second wall segment 34.

The third extending segments 43 each extends from the one of ends of the second extending segment 42 which is located at the position is located nearer from each other toward the terminal 2 in a longitudinal direction of the terminal 2. The third extending segments 43 each is provided at the center position between the third wall segment 35 and the partition wall 21 in the direction of arranging the terminals in parallel. The third extending segments 43 each extends along the first and the second wall segment 33, 35 and the inner faces 16*a* and 16*b* of the side walls 13*a* and 13*b*.

The coupling segment 44 couples the ends of the third extending segments 43 nearest to the terminals 2 each other. The coupling segment 44 is located between the end of the partition wall 21 and the second wall segments 34. The coupling segment 44 extends along the inner faces 15*a*, 15*b* of the end walls 12*a*, 12*b* and the second wall segments 34.

In this way, the fusible body 5 consists of the first to third extending segments 41, 42 and 43 and coupling segment 44 so that it bends from the coupling position with the one of the terminals to the coupling position with the other thereof.

Like the fuse 1 according to the first embodiment, in operation, where the fuse 1 having the above configuration is mounted in the electric connecting box, if the current value of the power supplied to one of the terminals 2 through the one receiving terminal exceeds the prescribed current value, the fusible body 5 fuses to stop the supply of the power to the load.

Like the fuse 1 according to the first embodiment in the fuse 1 according to this embodiment, the partition wall 21 of the housing 4 is located between the terminals 2 and also extends along the terminals 2. In addition, the partition wall 21 partitions the housing chamber 20 of the housing 4 into the first chamber 24 and the second chamber 25. Further, the second partition walls 22 extend from the end wall 12*a* with no partition wall 21 to the end wall 12*b* with the partition wall 21. The second partition walls 22 are located between the partition wall 21 and the side walls 13*a*, 13*b*, respectively.

Because of such a configuration, when the fusible body 5 is fused and deposited on the surfaces of the terminals 2, the partition walls 21 and 22 prevent the fusible body thus deposited from being connected mechanically and electrically.

Therefore, after the fusible body 4 has fused, the fuse 1 can prevent the pair of the terminals 2 from being communicated with each other. Thus, when the power with a current value which exceeds the fusing current value of the fusible body is supplied, supply of the power to the load can be surely stopped.

Further, the second partition walls 22, each of which covers the end face 27, step face 11 and flat face 10 of each of the pair of terminals 2, suppress the deposition of the fused fusible body 5 on the surface of each of the terminals 2.

Therefore, after the fusible body 4 has fused, the fuse 1 can prevent the pair of the terminals 2 from being communicated with each other. Thus, when the power with a current value which exceeds the fusing current value of the fusible body is supplied, supply of the power to the load can be surely stopped.

Further, the partition wall 21 and the second partition walls 22 extend to the central position between the inner faces 15*a* and 15*b* of the end wall 12*a* and 12*b*. For this reason, when the fusible body 5 is fused and deposited on the surfaces of the terminals 2, the partition walls prevent the fusible body thus deposited from being connected mechanically and electrically.

Between the coupling position with the one terminal 2 and the coupling position with the other terminal 2, the fusible 5 is formed to bend along the one of the second partition walls 22, inner faces of the end walls 12, 12*b*, partition wall 21 and the other of the second partition walls 22. This makes it difficult for the fused fusible body 5 to be deposited on the surfaces of the terminals 2. Therefore, after the fusible body 4 has fused, the fuse 1 surely prevents the pair of the terminals 2 from being communicated with each other. Thus, when the power with a current value which exceeds the fusing current value of the fusible body is supplied, supply of the power to the load can be surely stopped.

In this embodiment, the partition wall 21 is formed to extend from the inner face 15*b* of the end wall 12*b* whereas the second partition walls 22 are formed to extend from the inner face 15*a* of the end wall 12*a* in which the through-holes 18 are formed. However, inversely, the partition wall 21 maybe formed to extend from the inner face 15*a* of the end wall 12*a* whereas the second partition walls 22 may be formed to extend from the inner face 15*b* of the end wall 12*b*.

In the first and the second embodiment, although the partition walls 21 and 22 are formed integrally to the inner faces 15*a* and 15*b* of the end walls 12*a* and 12*b*, they may be formed the inner faces 17 of the frame walls 14.

Figure 6:
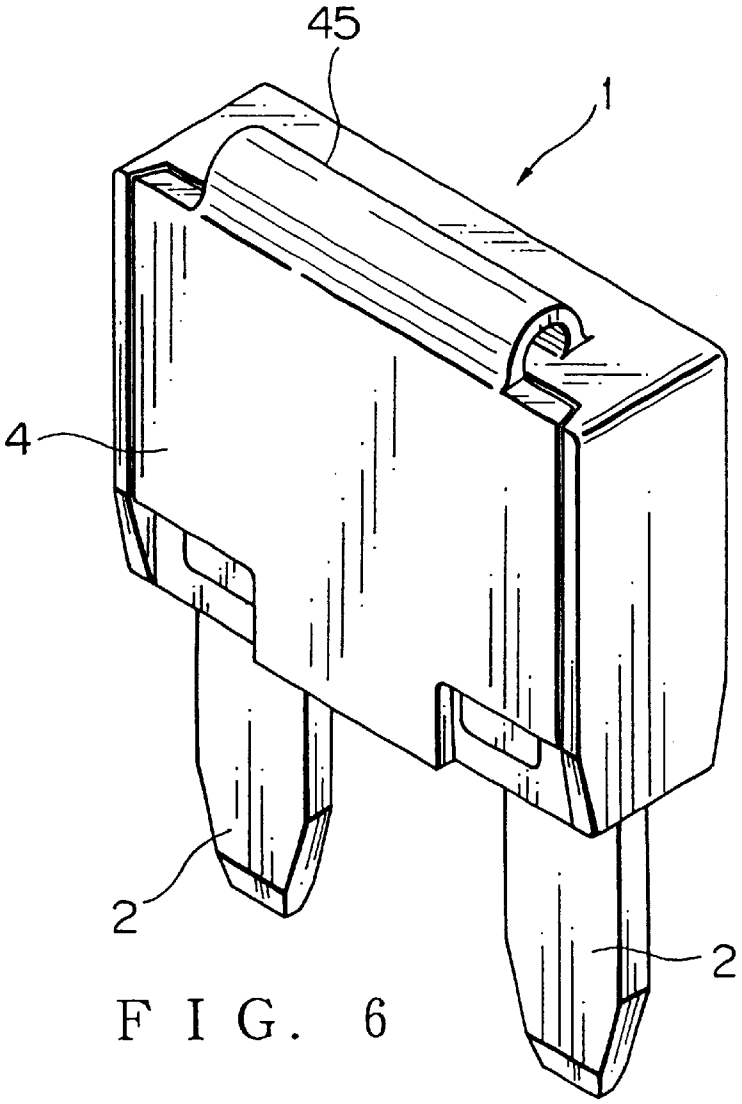
FIG. 6 is a perspective view of a modification of the fuse according to this invention.

The housing 4 of the fuse 1 according to the first and the second embodiment may be provided with knob 45 as shown in FIG. 6. The knob 45 is formed to protrude outwardly from the edge of the housing 4. By picking up the knob 45, the fuse 1 can be removed from a junction block, relay box or fuse block.

What is claimed is:

1. A fuse including a pair of terminals arranged in parallel, a housing having a housing chamber for housing respective one ends thereof and a fusible body for coupling said pair of terminals with each other, wherein said housing comprises:

a pair of first inner walls which constitute said housing chamber and are opposite to each other in a direction orthogonal to the direction of arranging said pair of terminals in parallel;

a first partition wall which is located between said pair of terminals in the direction of arranging the terminals in parallel and extends from the one of said first inner walls toward the other thereof;

a pair of second inner walls which constitute said housing chamber and are opposite to each other in a direction of arranging said terminals in parallel, and a pair of second partition walls which extend from said other of said first inner walls toward said one thereof and located between said first partition wall and said pair of second inner walls, respectively, in a direction of arranging the terminals in parallel.

2. A fuse according to claim 1, wherein said first partition wall and said pair of second partition walls extend to a center position between said pair of first inner walls.

3. A fuse according to claim 2, wherein said housing chamber is partitioned into a first chamber and a second chamber by said first partition wall, said first and said second chamber housing the ends of said pair of terminals, respectively, and between a coupling position with the one of said pair of terminals and another coupling position with the other thereof, said fusible body is formed to bend along the one of the second partition walls, the first inner walls, first partition wall and the other of said second partition walls.

* * * * *